US009943851B2

(12) United States Patent
Watts

(10) Patent No.: US 9,943,851 B2
(45) Date of Patent: Apr. 17, 2018

(54) APPARATUS AND PROCESS FOR DEMANUFACTURING MATERIALS FROM COMPOSITE MANUFACTURES

(71) Applicant: ENERGY CREATES ENERGY LLC, Kansas City, MO (US)

(72) Inventor: Kyle T. Watts, Lee's Summit, MO (US)

(73) Assignee: ENERGY CREATES ENERGY LLC, Kansas City, MO (US)

( * ) Notice: Subject to any disclaimer, the term of this patent is extended or adjusted under 35 U.S.C. 154(b) by 1078 days.

(21) Appl. No.: 14/098,113

(22) Filed: Dec. 5, 2013

(65) Prior Publication Data

US 2014/0077009 A1 Mar. 20, 2014

Related U.S. Application Data

(63) Continuation of application No. 13/279,621, filed on Oct. 24, 2011, now Pat. No. 9,403,167.

(Continued)

(51) Int. Cl.

| | |
|---|---|
| ***B02C 7/08*** | (2006.01) |
| ***B02C 7/02*** | (2006.01) |
| ***B02C 13/09*** | (2006.01) |
| ***B02C 18/12*** | (2006.01) |
| ***B02C 23/28*** | (2006.01) |
| ***B02C 13/18*** | (2006.01) |

(Continued)

(52) U.S. Cl.

CPC ..... *B02C 7/08* (2013.01); *B02C 7/02* (2013.01); *B02C 13/09* (2013.01); *B02C 13/18* (2013.01); *B02C 13/1814* (2013.01); *B02C 13/282* (2013.01); *B02C 18/12* (2013.01); *B02C 23/10* (2013.01); *B02C 23/28* (2013.01)

(58) Field of Classification Search

CPC .... B02C 7/02; B02C 7/06; B02C 7/08; B02C 7/10; B02C 7/17; B02C 13/02; B02C 13/09; B02C 13/10; B02C 13/14; B02C 13/1807; B02C 13/1814; B02C 13/185; B02C 13/288; B02C 23/24; B02C 23/28; B02C 23/38

USPC ..... 241/55, 56

See application file for complete search history.

(56) References Cited

U.S. PATENT DOCUMENTS 2,700,512 A 1/1955 Denovan et al.
3,065,919 A * 11/1962 Le Roy Burkett . B02C 13/1814 241/161

(Continued)

FOREIGN PATENT DOCUMENTS

WO 2011002752 1/2011

OTHER PUBLICATIONS

The International Search Report and Written Opinion dated May 17, 2012, based on PCT/US2011/057528 filed Oct. 24, 2011.

(Continued)

*Primary Examiner* — Matthew G Katcoff
(74) *Attorney, Agent, or Firm* — Hovey Williams LLP

(57) ABSTRACT

A process for separating carpet fibers from carpet backing uses a grinder of the type having a rotor with a plurality of vertically spaced cutter discs and a fan disc below the cutter discs. Sections of carpet are fed into the grinder which grinds the carpet, separating the fibers from the backing and breaking the backing into relatively small particles. The grinder is connected with a series of ginning equipment for removing the ground backing from the fibers.

10 Claims, 14 Drawing Sheets

Related U.S. Application Data

(60) Provisional application No. 61/405,936, filed on Oct. 22, 2010.

(51) Int. Cl.
*B02C 23/10* (2006.01)
*B02C 13/282* (2006.01)

(56) References Cited

U.S. PATENT DOCUMENTS

| | | | | |
|---|---|---|---|---|
| 4,637,556 | A | 1/1987 | Dunn | |
| 4,700,903 | A | 10/1987 | Henn | |
| 5,192,029 | A * | 3/1993 | Harris | B02C 13/14 241/154 |
| 5,277,758 | A | 1/1994 | Brooks et al. | |
| 5,340,036 | A | 8/1994 | Riley | |
| 5,680,994 | A | 10/1997 | Eide et al. | |
| 6,065,697 | A | 5/2000 | Engel et al. | |
| 7,950,601 | B2 | 5/2011 | Watts | |
| 2009/0305619 | A1 | 12/2009 | Schmied et al. | |

OTHER PUBLICATIONS

The International Preliminary Report dated May 2, 2013, based on PCT/US2011/057528 filed Oct. 24, 2011.

* cited by examiner

APPARATUS AND PROCESS FOR DEMANUFACTURING MATERIALS FROM COMPOSITE MANUFACTURES

RELATED APPLICATION

The present application is based upon U.S. Provisional Patent Application Ser. No. 61/405,936, filed Oct. 22, 2010, and U.S. patent application Ser. No. 13/279,621, filed Oct. 24, 2011, and titled APPARATUS AND PROCESS FOR DEMANUFACTURING MATERIALS FROM COMPOSITE MANUFACTURES, and of which the entire disclosures are hereby expressly incorporated by reference.

BACKGROUND OF THE INVENTION

Field of the Invention

The present invention relates to grinders, mills or shredders used to convert a material from an unprocessed state to a processed state having a reduced particle size and use of such mills for processing carpet to remove the carpet fibers from the backing, plastic bottles from the labels and the like.

Description of the Related Art

Interest in recycling of carpet, plastic bottles and other composite manufactures to limit the amount of materials going into landfills is growing, but existing processes are unsatisfactory. For the recycled material to be useable, the composite must be broken down into its components. In one currently utilized process, shears are used to cut the fibers from the backing. This process typically recovers less than fifty percent of the carpet fibers, leaving a considerable quantity of fibers un-reclaimed and the remaining backing and fibers must still be disposed. There remains a need for equipment and a process for recycling carpet and other composite goods including rigid and non-rigid materials which results in the efficient and relatively thorough separation of the rigid from the non-rigid material.

SUMMARY OF THE INVENTION

The present invention comprises a grinder in combination with ginning equipment for processing carpet or other composite materials or composite goods including but not limited to rigid and non-rigid materials (and/or flexible and non-flexible materials) such as shoes formed of fabric and rubber and foam soles. The grinder is of the type having a plurality of cutter discs mounted in vertically spaced relation on a rotor within a housing. A fan disc is mounted below the lower cutter disc. Material is introduced through the top of the housing and flows down past and is ground by the rotating cutter discs and is then discharged from the housing by the fan disc. A baffle or deflector plate is mounted in the housing above the top cutter disc to prevent the ground material from wrapping around the rotor shaft. There is also a cylinder encasing the center shaft (labeled xy in FIG. 2) that can vary in size to the length of raw material being processed, ideally the circumference of the cylinder is of greater length of the longest non-rigid material feedstock. The ground material exiting the grinder is then directed through a series of ginning equipment and/or air classifier to separate the non-rigid fibers from the ground, non-fibrous rigid material, such as carpet fibers from the backing or the rigid bottle from the non-rigid label.

DETAILED DESCRIPTION OF THE PREFERRED EMBODIMENTS

Figure 1:
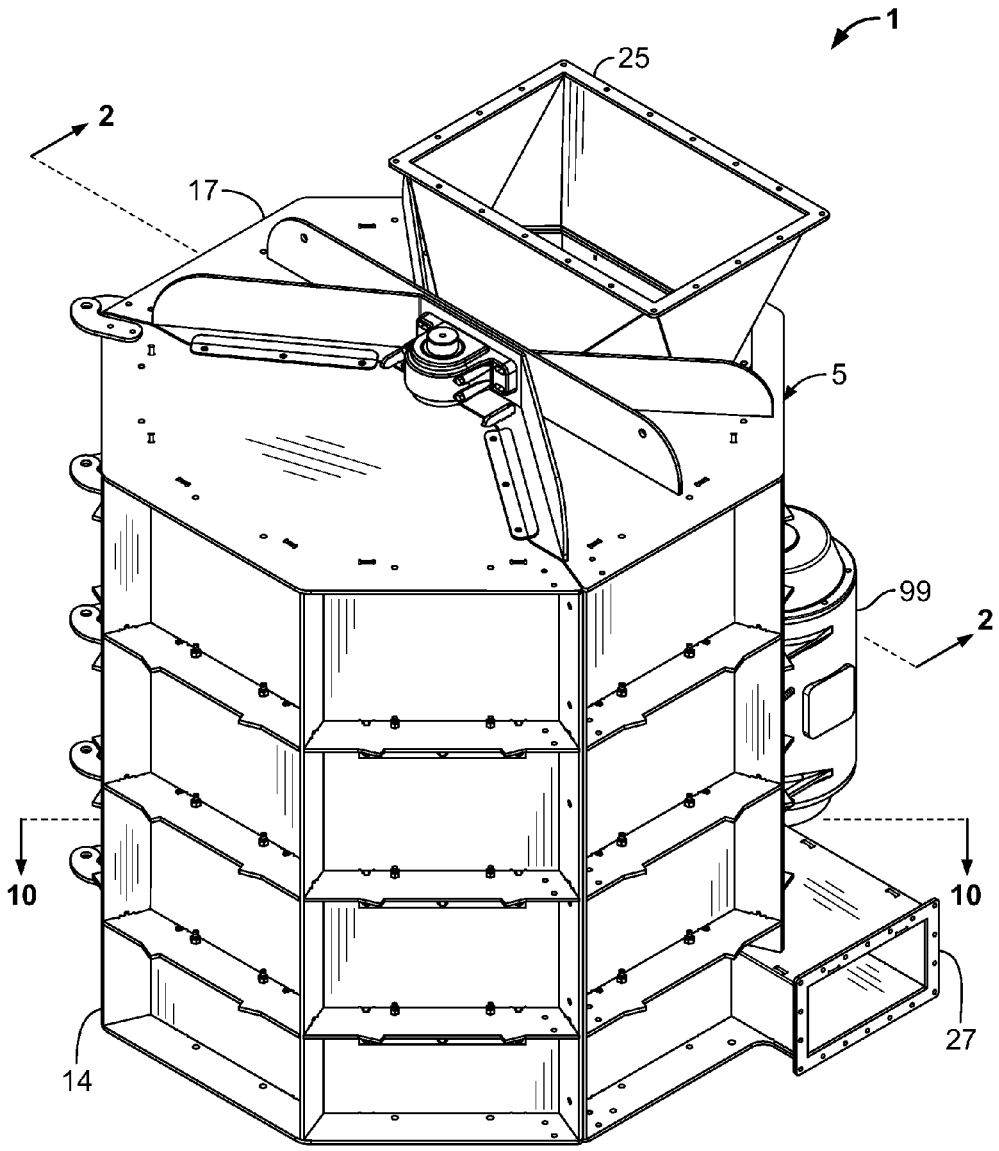
FIG. 1 is a perspective view of a grinder according to the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import. For purposes of the present invention the terms "rigid" and "flexible" are used interchangeably in reference to the types of materials, e.g. "rigid" and non-"rigid" or "flexible" and non-"flexible."

Referring to the drawings in more detail, the reference number 1 generally designates a grinder according to the present invention. The grinder 1 includes a rotor 3 rotatably mounted in a housing 5. The rotor 3 includes a generally vertical shaft 7 and a plurality of cutter discs 9 longitudinally mounted on the shaft 7 and extending radially outward therefrom. A fan disc 10 is connected to the shaft 7 below the lowermost of the cutter discs 9 and spaced downwardly therefrom. For example, the drawings show three cutter discs 9 denominated as discs 9*a*, 9*b*, and 9*c* from top to bottom, with the fan disc 10 spaced downwardly from cutter disc 9*c*.

Each cutter disc 9 has a plurality of cutter blades or hammers 11 connected thereto which extend radially outward past the outer edge of the respective cutter disc 9. Four hammers 11 arranged at 90 degree intervals are shown for each of the cutter discs 9. The hammers 11 are each shown as being rigidly connected to the top surface of the respective cutter disc 9 by a pair of bolts 13. It is foreseen, however, that each hammer 11 could be fastened by only a single bolt 13 so as to pivot or swing about the bolt 13 relative to the respective cutter disc 9.

The housing 5 is generally octagonal in shape and includes a sidewall 14 comprising eight sidewall sections 15, a top wall 17 and a bottom wall 19. The housing 5 includes a door 21, comprising three of the sidewall sections 15, which is hingedly connected to a main housing 23 which comprises the remaining five sidewall sections 15. The top and bottom walls 17 and 19 are each divided into respective first sections 17*a* and 19*a* which form part of the main housing 23 and respective second sections 17*b* and 19*b* which form part of the door 21. The line of division between the first sections 17*a* and 19*a* and the second sections 17*b* and 19*b* preferably extends through the axis of rotation of the shaft 7 such that the rotor 3 may be easily installed or removed through the opening provided by swinging open the door 21. An entrance chute 25 for admitting material into the grinder 1 is formed on the top wall 17 and communicates with the interior of the housing 5 through an opening in the top wall 17. A discharge chute 27 for discharging material from the grinder 1 is formed through the sidewall 14 and communicates with the interior of the housing 5 through an opening formed in the sidewall 14 just above the plane of rotation of the fan disc 10.

The shaft 7 of the rotor 3 is rotatably journaled to the main housing section 23 by upper and lower bearings 29 and 31 respectively. The upper bearing 29 is mounted in a pillow block 32 located immediately above the top wall 17 and connected to an upper framework 33 which is fixed to the top wall 17. Similarly, the lower bearing 31 is mounted in a pillow block 34 located immediately below the bottom wall 19 and connected to a lower framework 35 which is fixed to the bottom wall 19.

Figure 3:
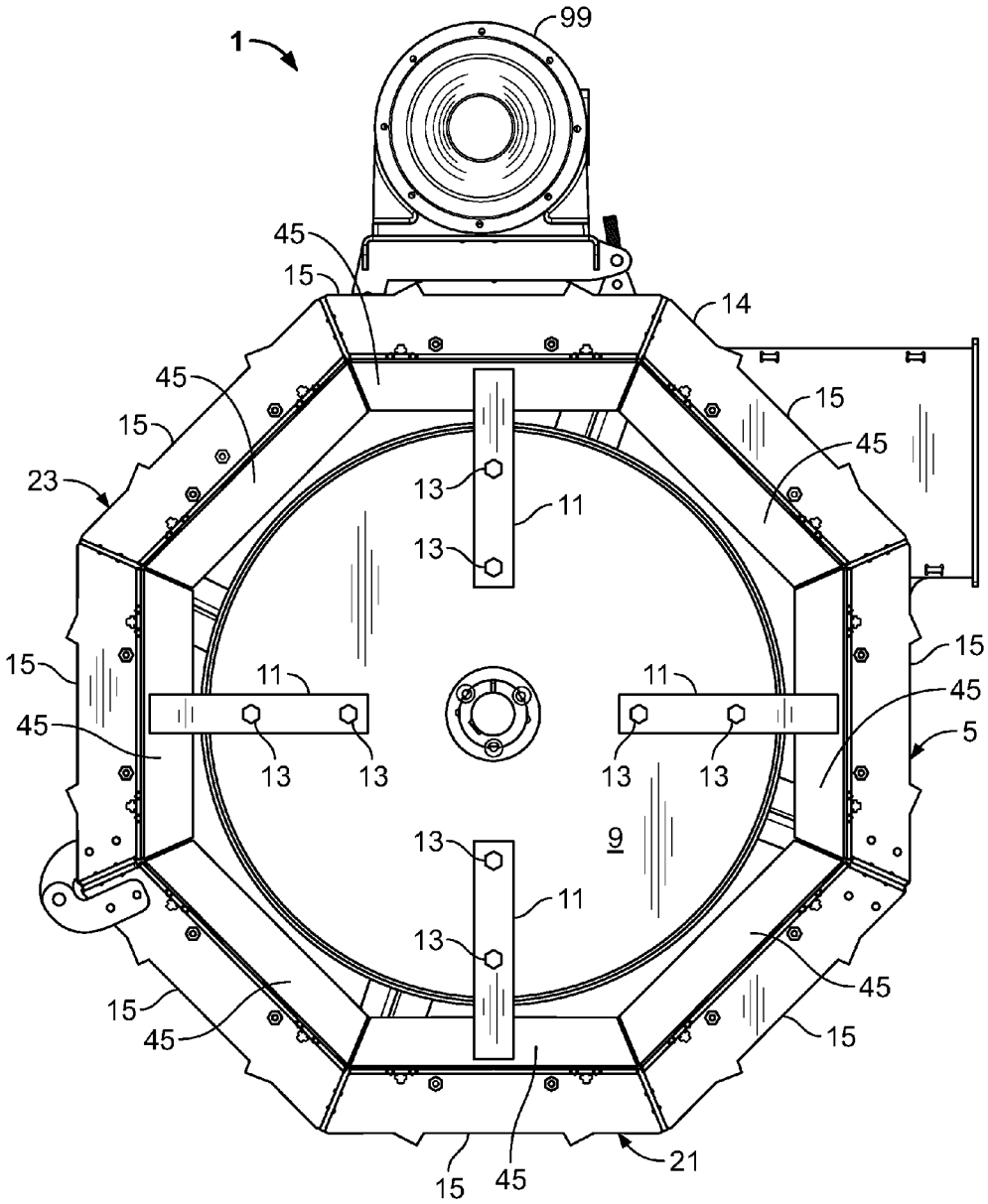
FIG. 3 is a cross sectional view of the grinder taken generally along line 33 in FIG. 2.
Figure 4:
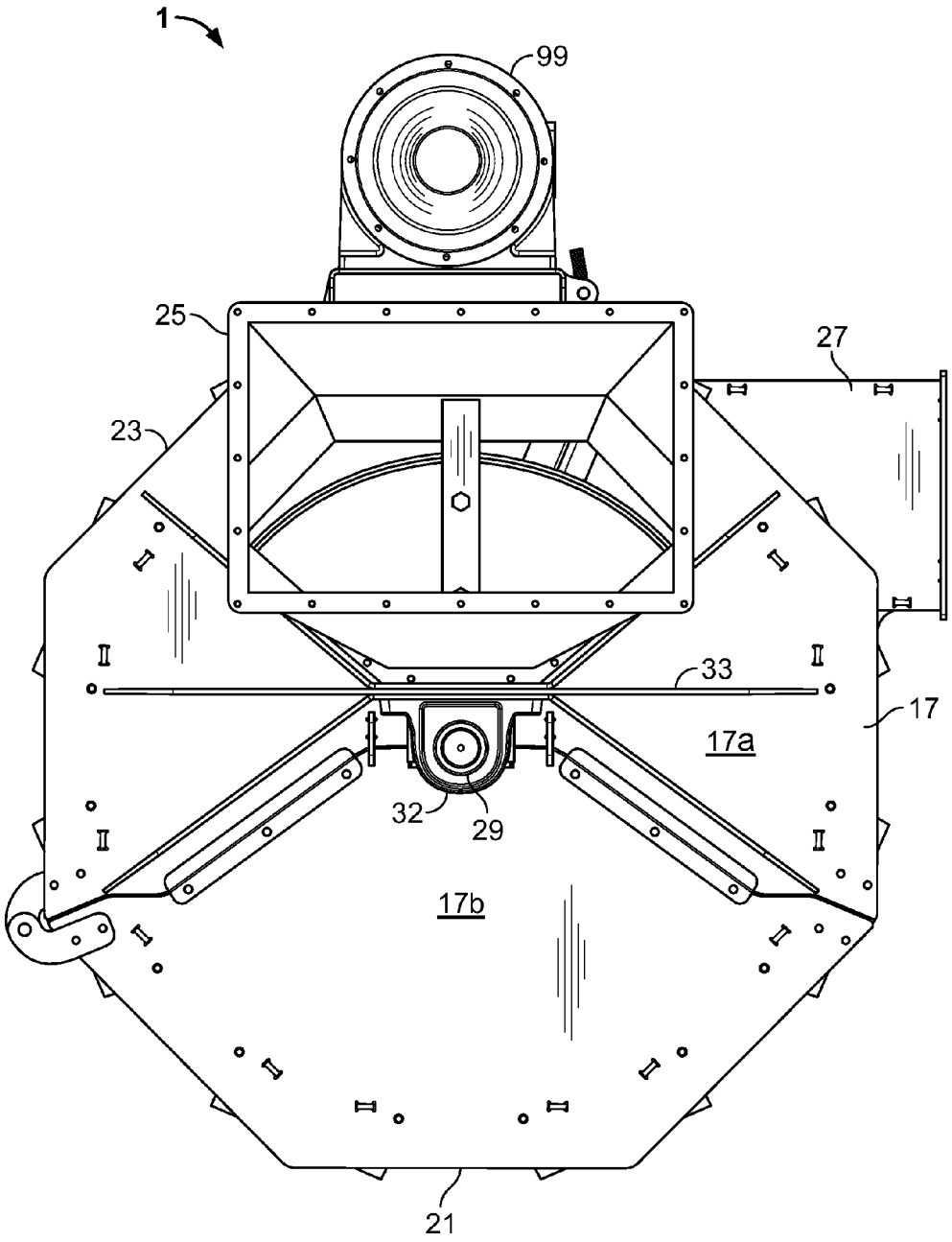
FIG. 4 is a top plan view of the grinder.
Figure 5:
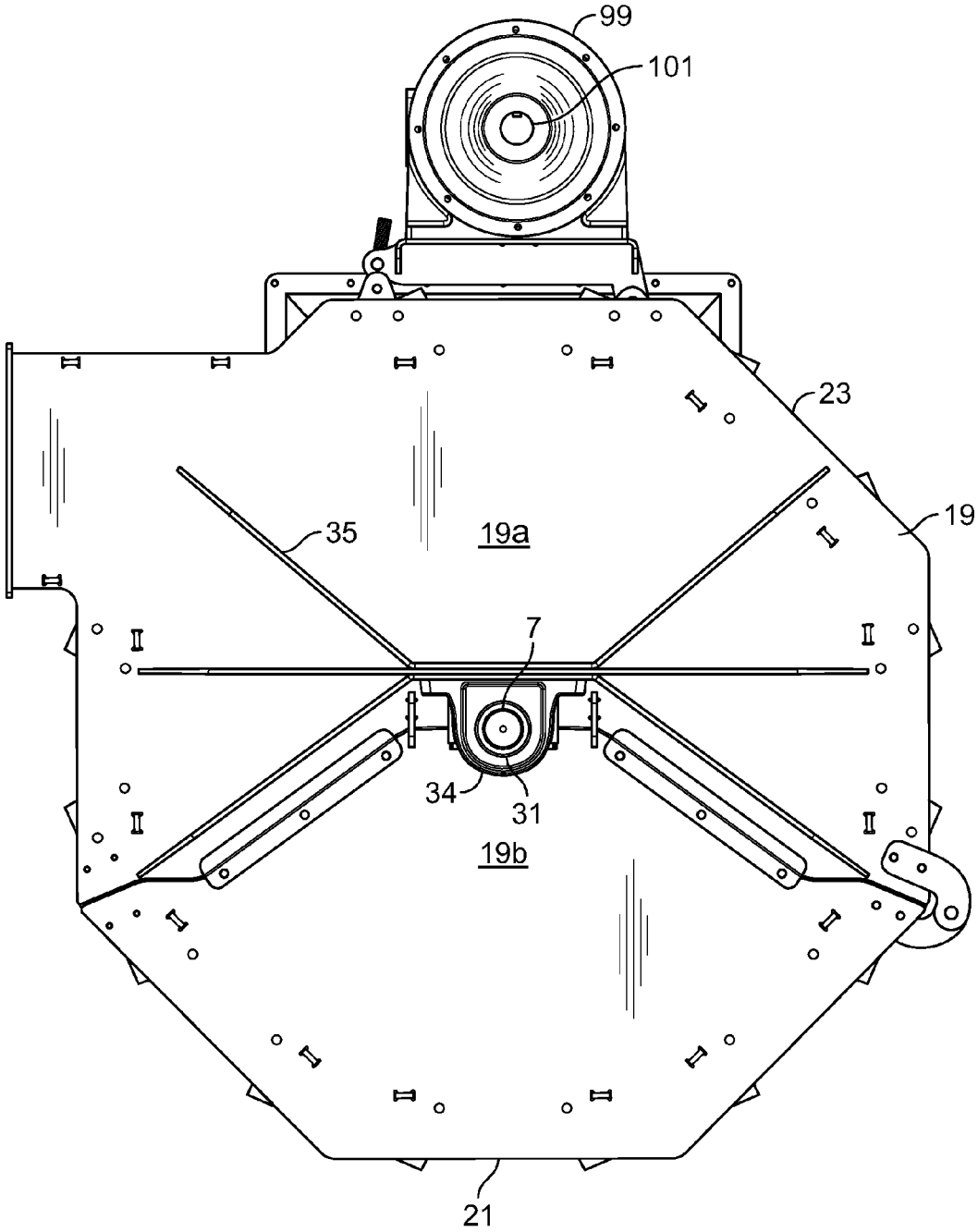
FIG. 5 is a bottom plan view of the grinder.
Figure 7:
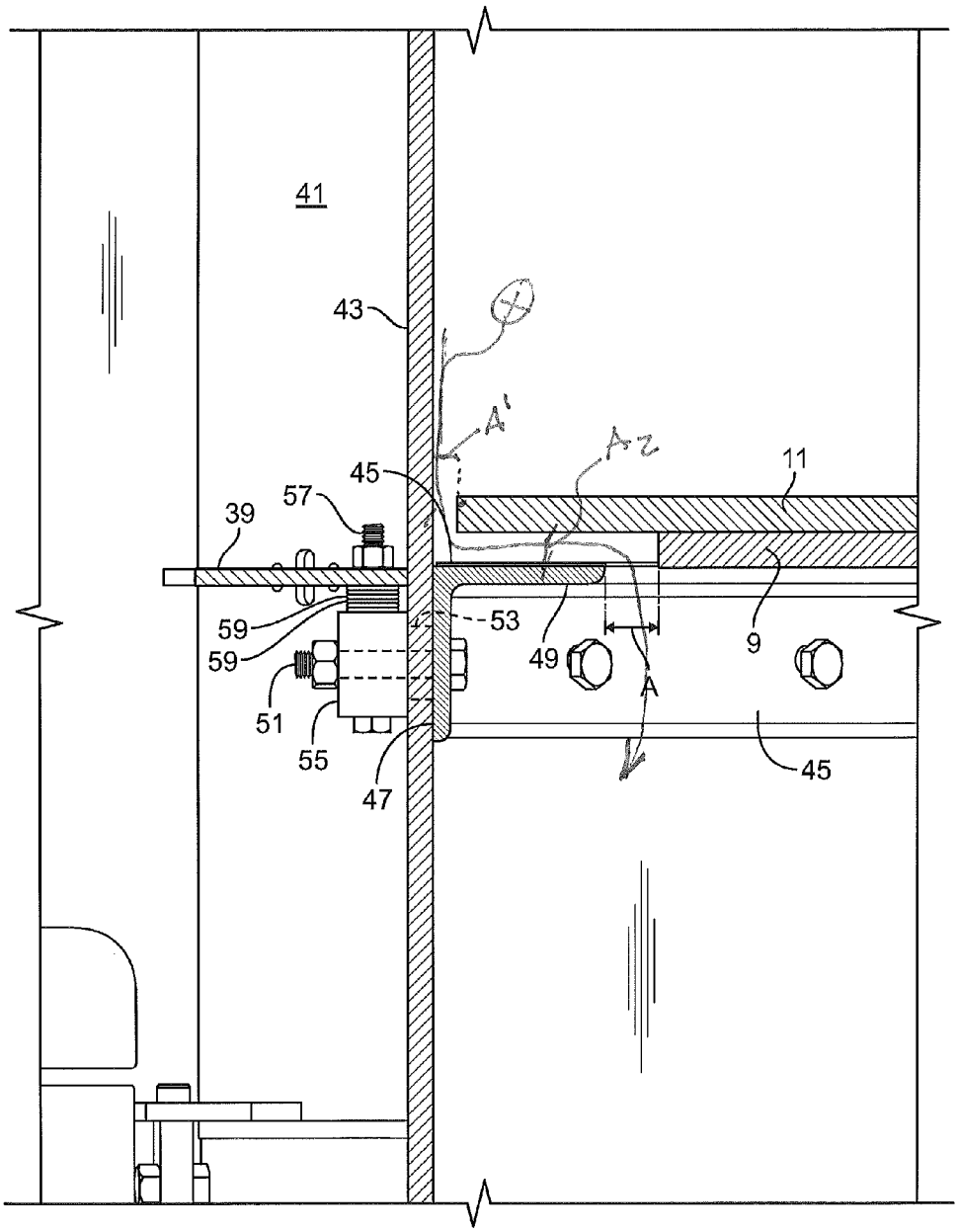
FIG. 7 is an enlarged fragmentary cross-sectional view similar to FIG. 2 showing mounting detail for angle deflectors which form a portion of the grinder.

Each sidewall section 15 includes a sidewall framework 37 comprising a plurality of horizontal ribs 39 extending between vertical ribs 41. A respective replaceable wear plate 43 covers the interior of each sidewall framework 37. Mounted to the interior surface of each wear plate 43 are a plurality of angle deflectors 45, the number of angle deflectors 45 on each sidewall section 15 being equal in number to the number of cutter discs 9. As best seen in FIG. 7, each angle deflector 45 includes a vertical flange 47 positioned in abutment against the interior surface of the respective wear plate 43 and a horizontal flange 49 which extends inwardly from the respective sidewall section 15. The angle deflectors 45 are positioned such that the horizontal flanges 49 are each in general alignment with the outer edge of a respective one of the cutter discs 9 such that the respective hammers 11 move in closely spaced relation to the upper surface of the horizontal flange 49. As shown in FIG. 3, the ends of the angle deflectors 45 are cut at an angle (67.5 degrees) such the horizontal flanges 49 of angle deflectors 45 on adjacent sidewall sections 15 cooperate to form octagonal shelves which extend continuously around the interior of the housing 5.

Figure 6:
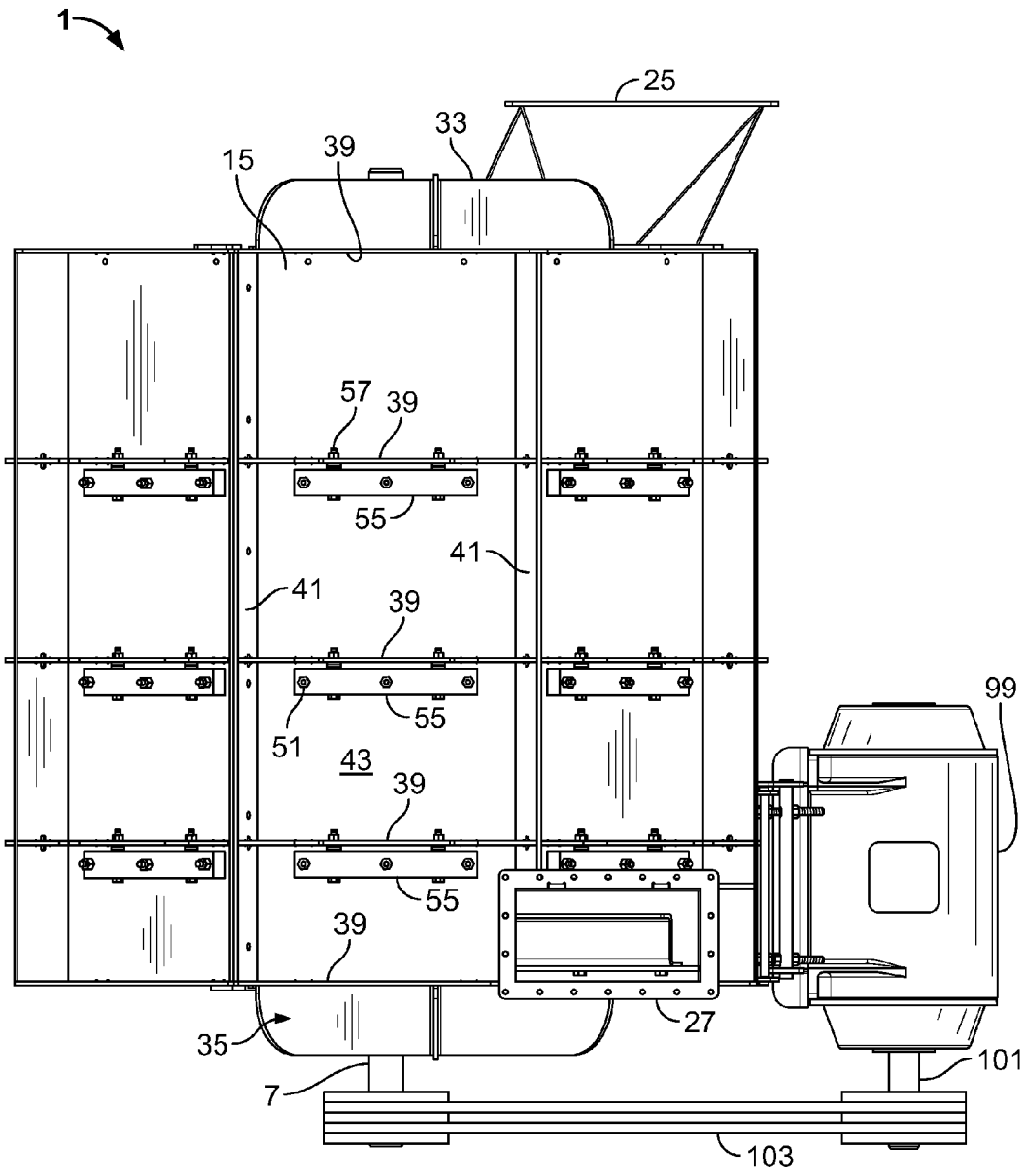
FIG. 6 is a side elevational view of the grinder.

The angle deflectors 45 are mounted to the respective sidewall sections 15 in such a manner that the position of each angle deflector 45 can be fine-tuned to insure proper alignment with the respective cutter disc 9. Referring again to FIG. 7, a plurality of bolts 51 (three shown in FIG. 6) extend through holes in the vertical flange 47 of each of the angle deflectors 45, through oblong or oversize openings 53 in the respective wear plate 43, and through horizontal holes in a respective adjustment block 55. The adjustment blocks 55 are each connected to the sidewall framework 37 by vertical bolts 57 which extend through aligned holes in the adjustment block 55 and in a respective one of the horizontal ribs 39 of the respective sidewall framework 37. Shims, washers or spacers 59 can be placed around the vertical bolts 57 between the adjustment block 55 and horizontal rib 39 to adjust the height of the adjustment block 55 and connected angle deflector 45 within the range of the oblong openings 53 in the respective wear plate 43.

A gap A is defined between the outer edge of each cutter disc 9 and the inner edge of the horizontal flanges 49 of the respective angle deflectors 45. The cutter discs 9*a*, 9*b*, and 9*c* are of somewhat increasing diameter from the top to the bottom of the grinder 1 such that the gap A decreases or for some materials increases. As best seen in FIG. 7 are what comprise the equipment's ability to distinguish and separate rigid from non-rigid for further processing. As the composite material travels along path (x) it encounters the hammers 11 at a steep angle, the tremendous force breaks apart most rigid materials while non-rigids absorb the energy, as it continues along its path it is drawn downward in part by the fan 10 and gravity, smaller rigid pieces pass through the two 90 degree turns and clearances A1, A2 and A, meanwhile as the non-rigid pieces get pulled through the chicane and set clearances it is stripped of rigid material because the non-rigids can take the shape of the chicane and rigids cannot. The pathway (x) and clearances A1, A2 and A can be adjusted according to the material and desired output.

Figure 2:
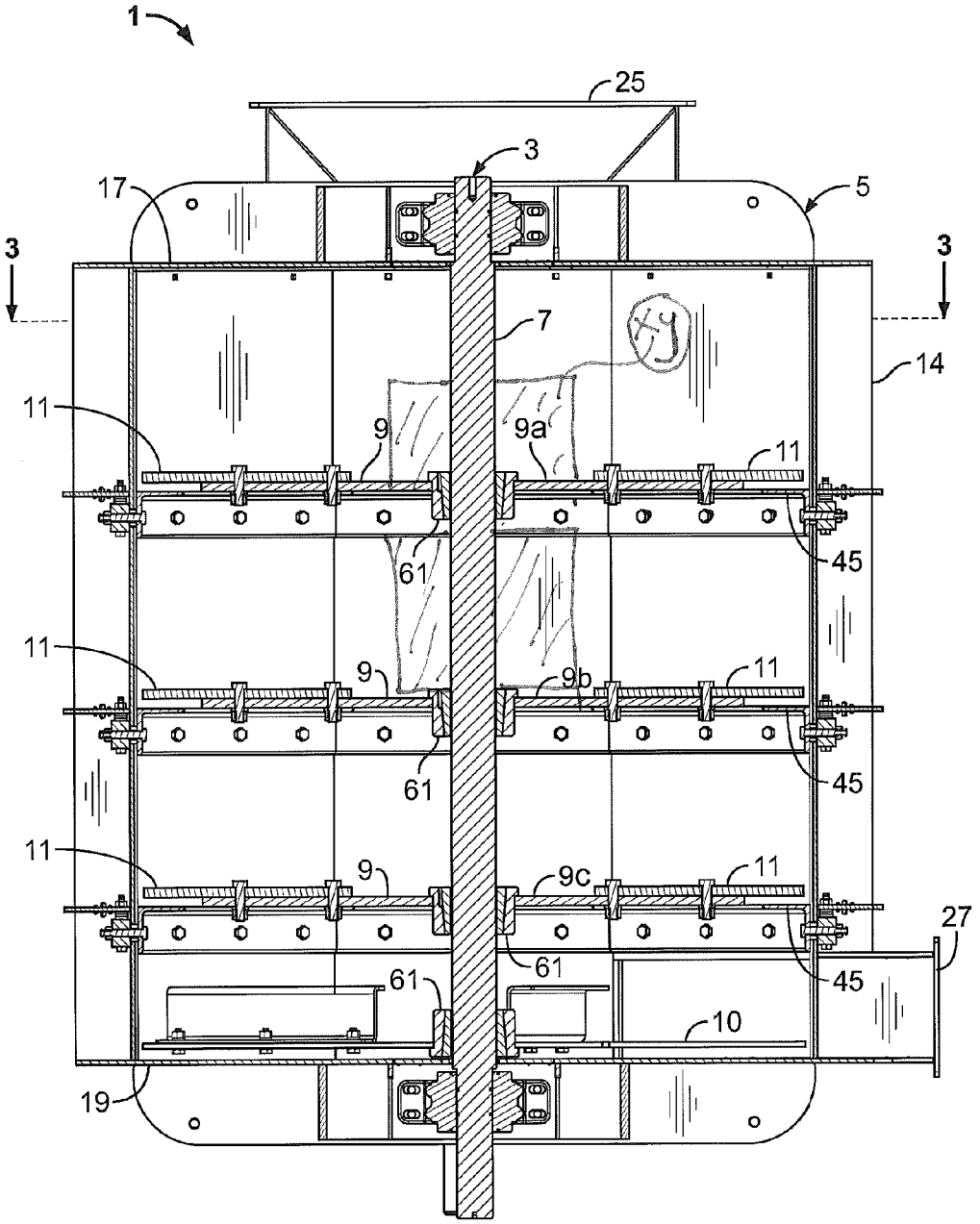
FIG. 2 is a cross sectional view of the grinder taken generally along line 22 in FIG. 1.
Figure 8:
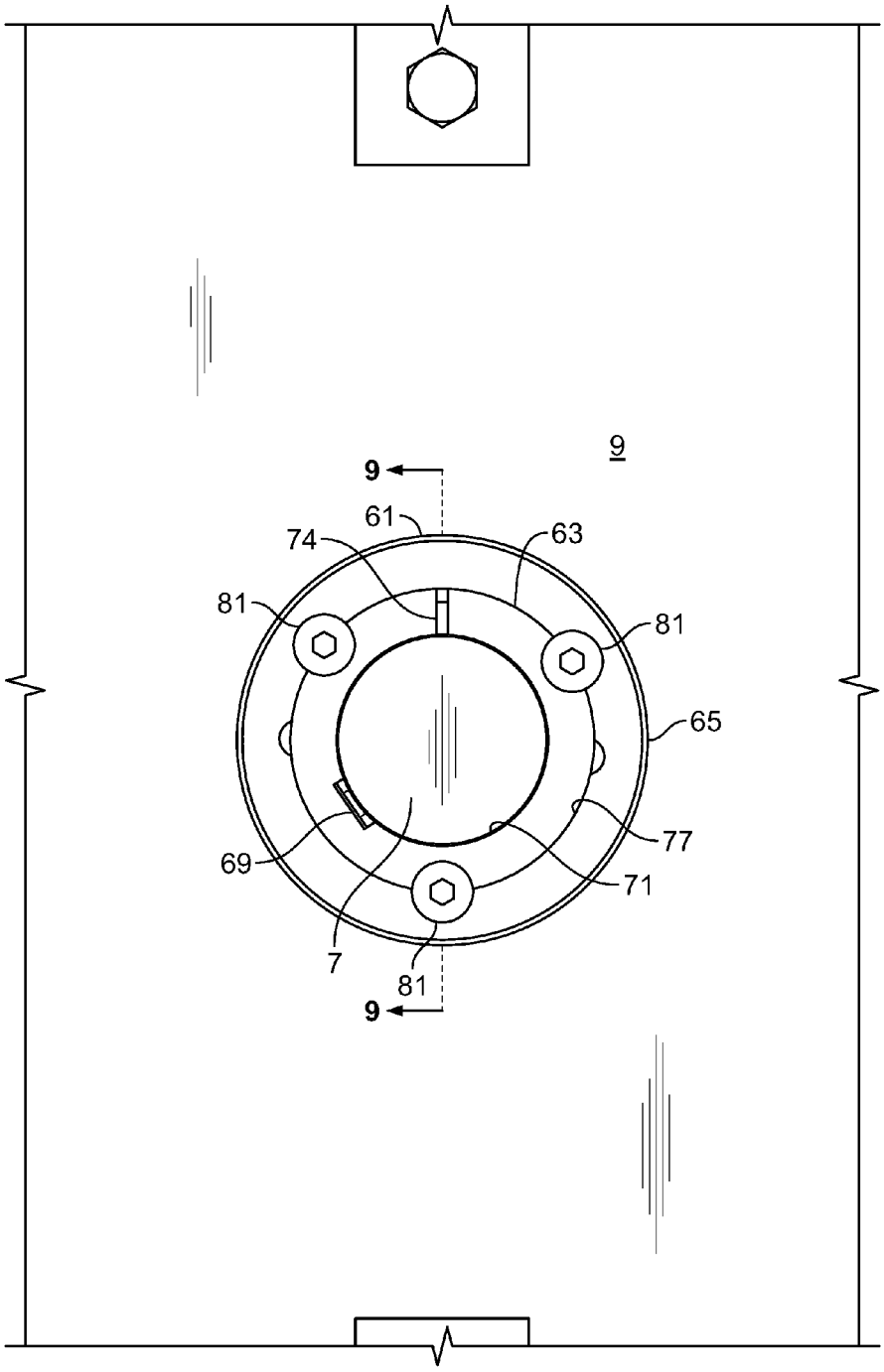
FIG. 8 is an enlarged fragmentary cross-sectional view similar to FIG. 3 showing a taper lock hub used for mounting cutter discs which form a portion of the grinder.
Figure 9:
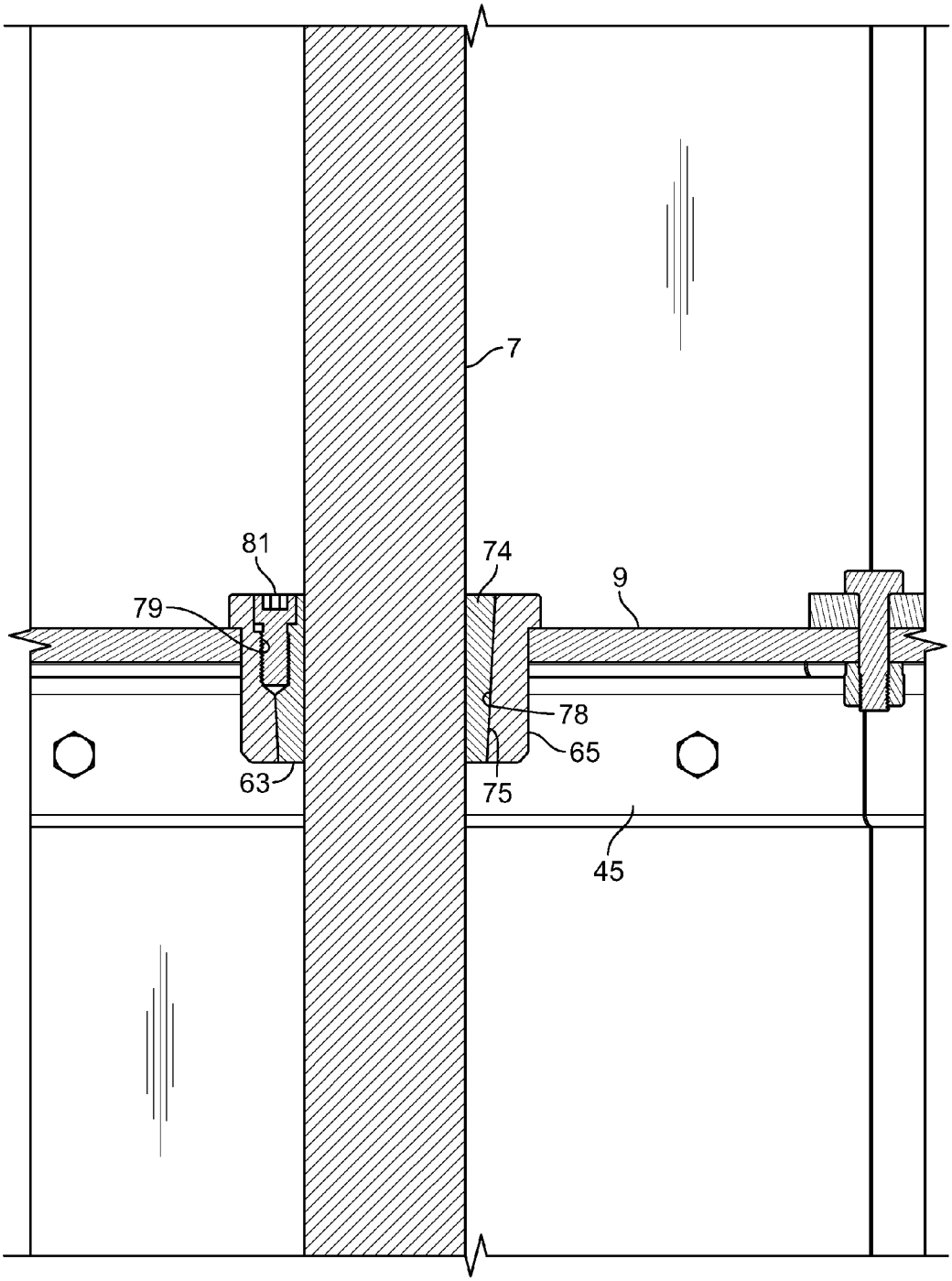
FIG. 9 is a cross-sectional view of the taper lock hub taken generally along line 99 in FIG. 8.

Referring to FIG. 2, the positions of the cutter discs 9 and fan disc 10 along the shaft 7 are also adjustable due to the use of taper lock hubs 61 to connect the discs 9 and 10 to the shaft 7. As best seen in FIGS. 8 and 9, each hub 61 includes an inner hub member 63 and an outer hub member 65. The respective cutter disc 9 or fan disc 10 is connected to the outer hub member 65, such as by welding. The shaft 7 includes a respective keyway formed therein for each of the discs 9 and 10. Each keyway 67 receives a key 69. The inner hub member 63 includes a shaft receiver 71 with a keyway 73 sized to receive the key 69. The inner hub member 63 includes a split 74 which allows it to be compressed against the shaft 7 and a tapered outer surface 75. The outer hub member 65 has a central bore 77 sized to receive the inner hub member 63 and an inner surface 78 tapered to match the outer surface 75 thereof. A plurality of fastener receivers 79 are formed between the inner hub member 63 and outer hub member 65 and receive threaded fasteners 81 for drawing the inner hub member 63 into the central bore 77 of the outer hub member 65.

With the fasteners 81 loose and the inner hub member 63 uncompressed, the hub 61 (and attached cutter disc 9 or fan disc 10) can be moved along the shaft 7 and repositioned anywhere within the limits of the length of the respective key 69. Once the cutter disc 9 is in the desired position, the fasteners 79 are tightened, drawing the inner hub member 63 into the tapered central bore 77 of the outer hub member 65 and compressing the inner nub member 63 against the shaft 7 to retain the hub 61 and disc 9 or 10 in position.

Figure 10:
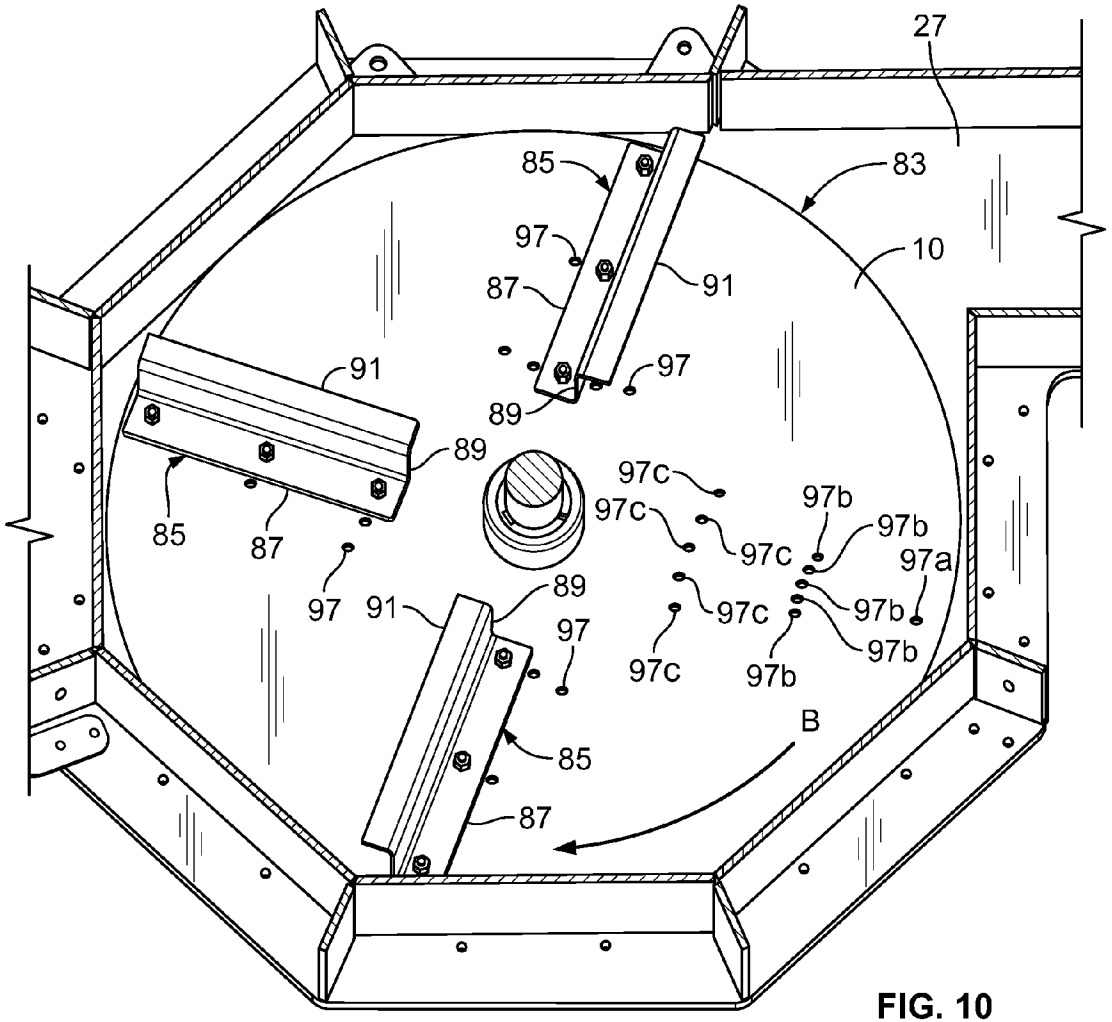
FIG. 10 is a cross-sectional perspective view taken generally along line 1010 in FIG. 1 and showing a fan assembly which forms a portion of the grinder. One fan blade of the fan assembly has been removed to show detail which would otherwise be obscured by the removed blade.

Referring to FIG. 10, the fan disc 10 forms part of a fan assembly 83 which acts to provide airflow through the grinder 1 and to thereby improve drying of the material, to help move material through the grinder 1, and to expel the ground material through the discharge chute 27. The fan assembly 83 includes a plurality of fan blades 85 which are affixed to the upper surface of the fan disc 10 in a generally radial orientation. Four fan blades 85 are provided in the embodiment depicted with three of the fan blades 85 being shown in FIG. 10. The fourth fan blade 84 has been deleted to show detail which would otherwise be concealed by the deleted fan blade 85. The fan blades 85 each include a bottom flange 87 securable to the fan disc 10, an upwardly extending web 89, and a top flange 91 which extends outwardly from the web 89 in the direction of rotation of the fan disc 10 (designated by arrow B). More specifically, in a preferred embodiment of the fan blade 85, the web 89 extends generally vertically upward from the leading edge of the bottom flange 87 (in the direction of rotation B of the fan disc 10). The top flange 91 then extends generally horizontally outward from the top edge of the web 89, again in the direction of rotation of the fan disc 10. It is foreseen, however, that the angles between the bottom flange 87, web 89 and top flange 91 could be other than right angles.

The bottom flange 87 of each of the fan blade 85 has a plurality of mounting holes formed therein for receiving fasteners 95 (three shown) used to connect the fan blades 85 to the fan disc 10. The fan disc 10 has mounting holes 97 formed therein for receiving the fasteners 95. It is preferred, however, that there be extra mounting holes 97 in the disc 10 to allow the blades 85 to be selectively repositioned to adjust the airflow through the grinder 1. For example, the disc 10 is shown in the drawings as having a single mounting hole 97*a* proximate the outer edge of the disc 10 for the outermost of the fasteners 95. The remaining fasteners 95 are provided with multiple mounting holes 97, arranged in arcuate rows. Five mounting holes 97*b* are shown for the middle fastener 95, and five mounting holes 97*c* are shown for the innermost fastener 95. By selectively pivoting the fan blades 85 about the fastener 95 in the outermost hole 97*a* and selecting different pairs of the mounting holes 97*b* and 97*c*, an operator of the grinder 1 can adjust the angular orientation of the fan blades 85 relative to a true radial orientation and thereby increase or decrease the airflow through the grinder 1 to best suit specific materials to be ground and operating conditions.

The rotor 3 of the grinder 1 is driven by a motor 99 which may be, for example, an electric or hydraulic motor. The motor 99 is mounted to one of the sidewall sections 15 and includes a shaft 101 which is operably connected to a lower portion of the shaft 7 below the bottom wall 19 of the housing 5, such as by a chain and sprocket or belt and sheave system 103.

The grinder 1 may be mounted on any suitable supporting structure, including a trailer (not shown) if it is desired to make the grinder 1 portable. Suitable conveyors may be provided for moving material into the inlet 25 and away from the outlet 27. It is foreseen that the grinder could be configured to fit inside a standard sized shipping container allowing efficient transportation to selected locations for grinding operations. Once the grinder is removed and set in place, the container could then be used as a receptacle for ground material. The container is then readily transportable to a landfill or other waste disposal facility for disposal of the ground material and can be replaced by another standard container to avoid interruptions in the grinding process.

Figure 11:
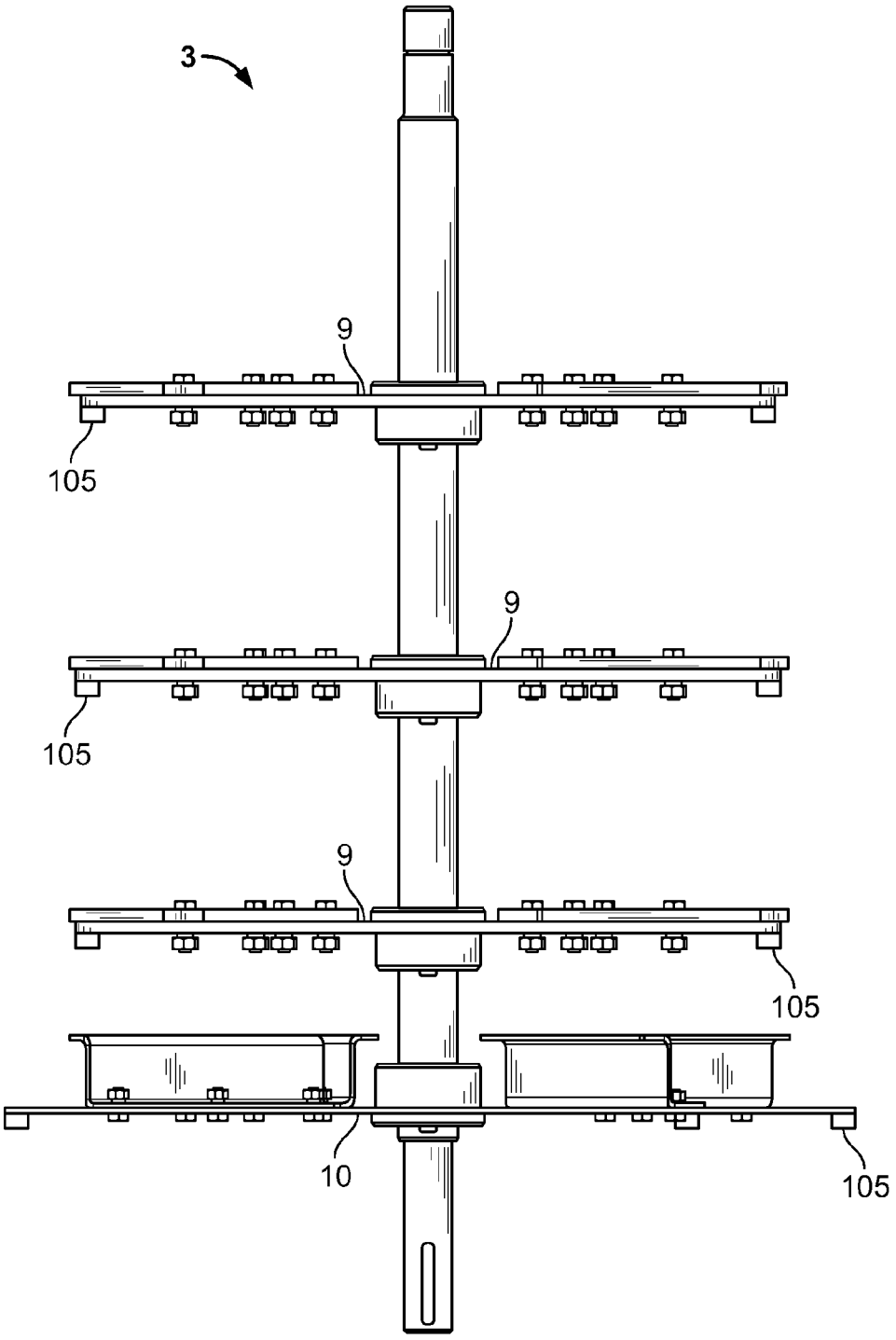
FIG. 11 is a cross-sectional view similar to FIG. 2 showing an alternative embodiment in which weights may be added to the cutter discs near an outer periphery thereof

With reference to FIG. 11, the cutter discs 9 or fan disc 10 may be built up or have weights 105 attached thereto to increase the inertia of the rotor 3 thereby increasing the mechanical advantage of the cutter discs 9 and associated hammers or blades 11 acting on the material processed therein and against the angle deflectors 45. The peripherally weighted discs on the rotor 3 function as flywheels keeping the cutter discs 9 rotating as the hammers or blades 11 strike the material to be ground. It is to be understood that only one of the cutter discs 9 or the fan disc may be weighted to function as a flywheel. The fan disc 10 and the lowermost cutter disc 9 are preferably the discs that are weighted to increase the stability of the rotor 3 which is driven from the lower end thereof.

Figure 12:
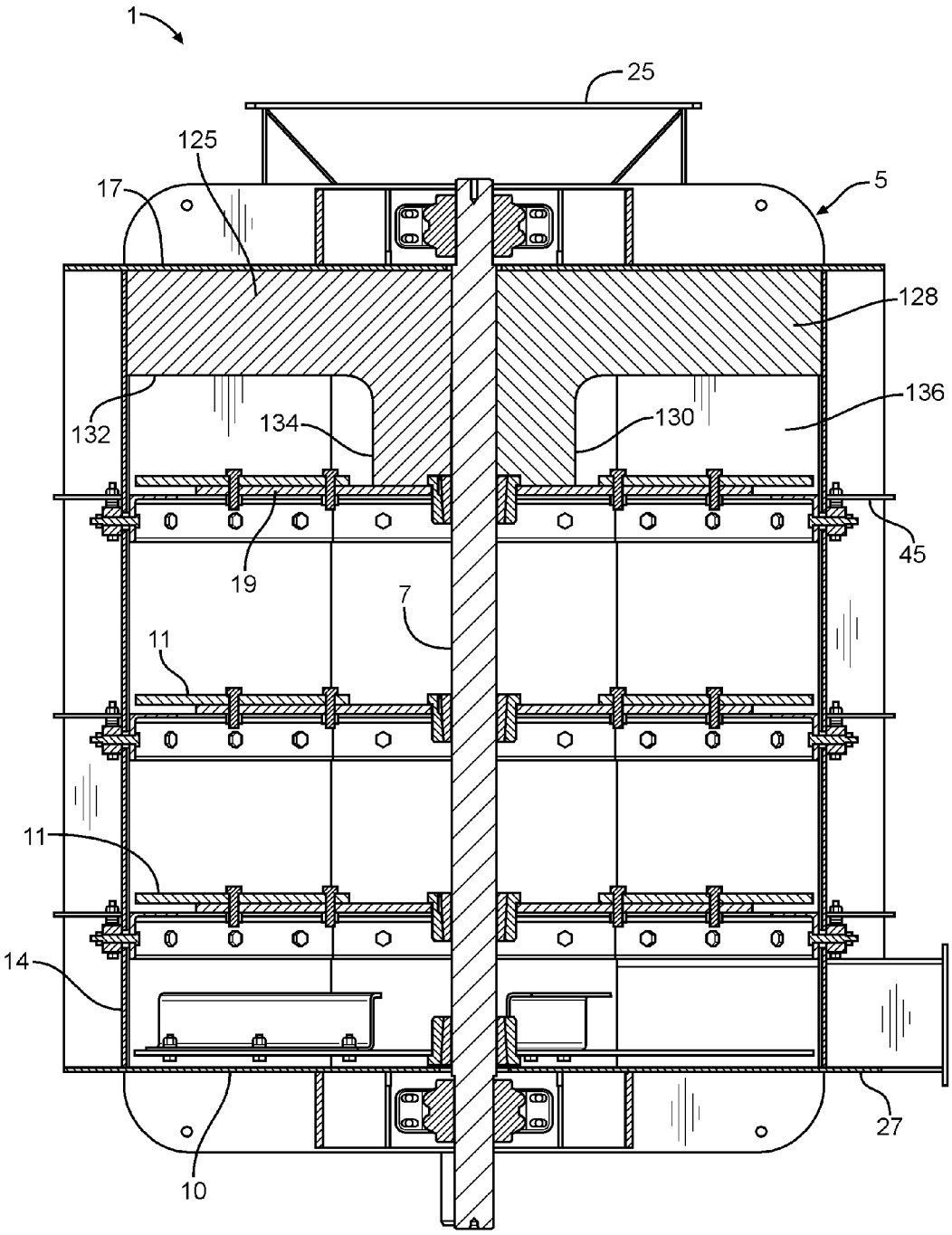
FIG. 12 is a cross-sectional view cross sectional view similar to FIG. 2 showing an alternative embodiment in which deflectors are supported above an upper cutter disc and extend across the grinder chamber in closely spaced relation to the shaft.
Figure 13:
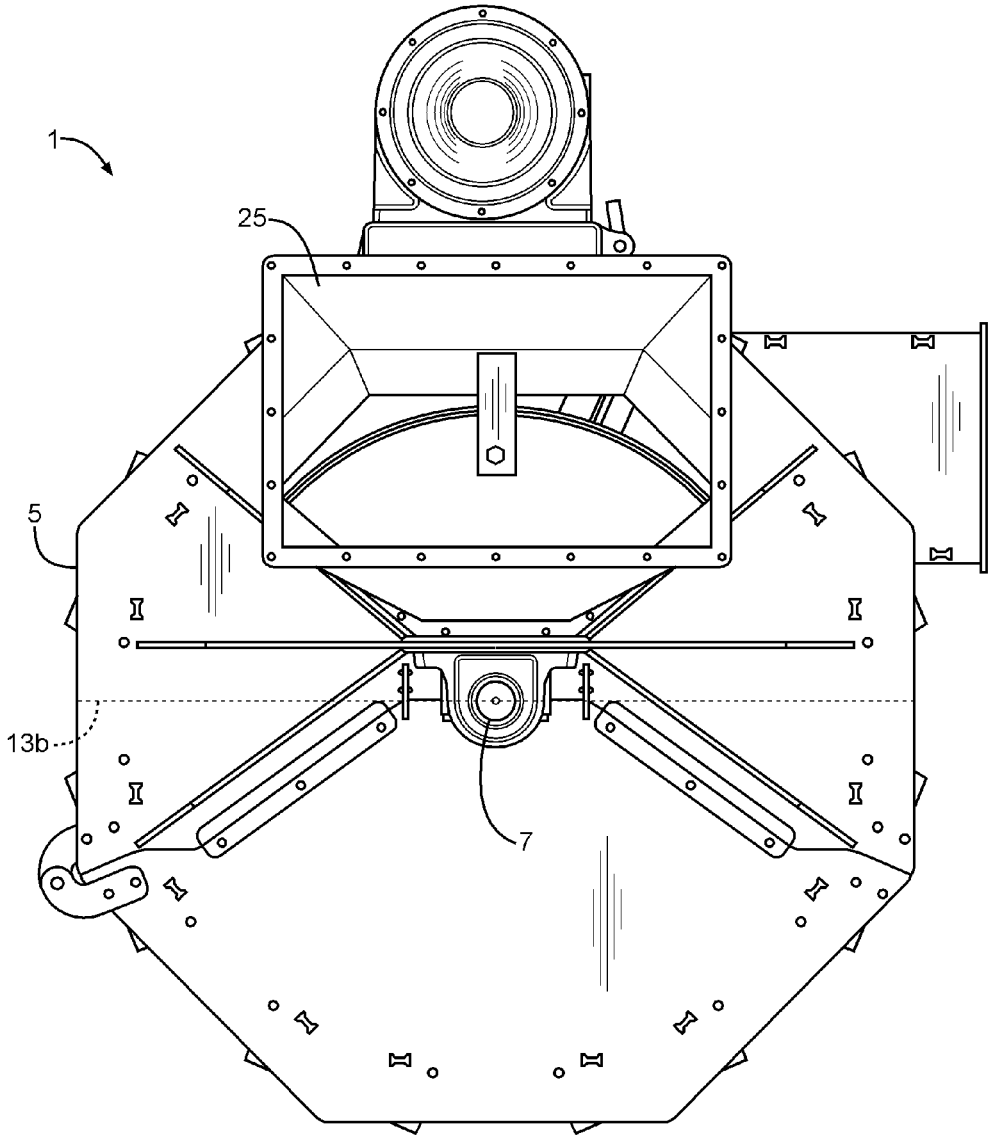
FIG. 13 is a top plan view of the grinder as shown in FIG. 12 with the deflector shown in phantom lines.

FIG. 12 is a cross-sectional view of a modified version of the grinder 1 having a pair of deflectors 125 fixedly mounted in the grinder 1 in the space above the first or upper cutter disc 9 and below the top wall 17. FIG. 13 is a top plan view of the grinder as shown in FIG. 12 with the deflector shown in phantom lines. Each deflector 125 is generally planar and may be formed from sheet metal and extends along a radius of the housing chamber, from the housing sidewall 14 towards the rotor shaft 7 with a relatively small gap formed between each deflector 125 and the shaft 7. The gap is preferably on the order of one quarter of an inch.

The deflectors 125 shown each comprise a main body or main portion 128 which extends downward from the top wall 17 toward the upper cutter disc 9. In the embodiment shown, the main body spans roughly half the distance between the top wall 17 and upper cutter disc 9. A deflector leg 130 depends from the deflector main body 128 on the side or end proximate the rotor shaft 7 and extends closer to the upper cutter disc 9 than the main body 128. A lower edge 132 of the main body and an outer edge of the leg 134 define a gap or channel 136 through which material to be ground can pass. The size of the gap 136 can be varied depending on the physical properties of the material to be ground. The deflectors 125 function to prevent or resist wrapping of string or strands around the rotor shaft 7. Once the strings or strands move past the first cutter disc 9, the hammers 11 chop or grind most of the strands to a length small enough that the strands do not wrap around the shaft 7.

Figure 14:
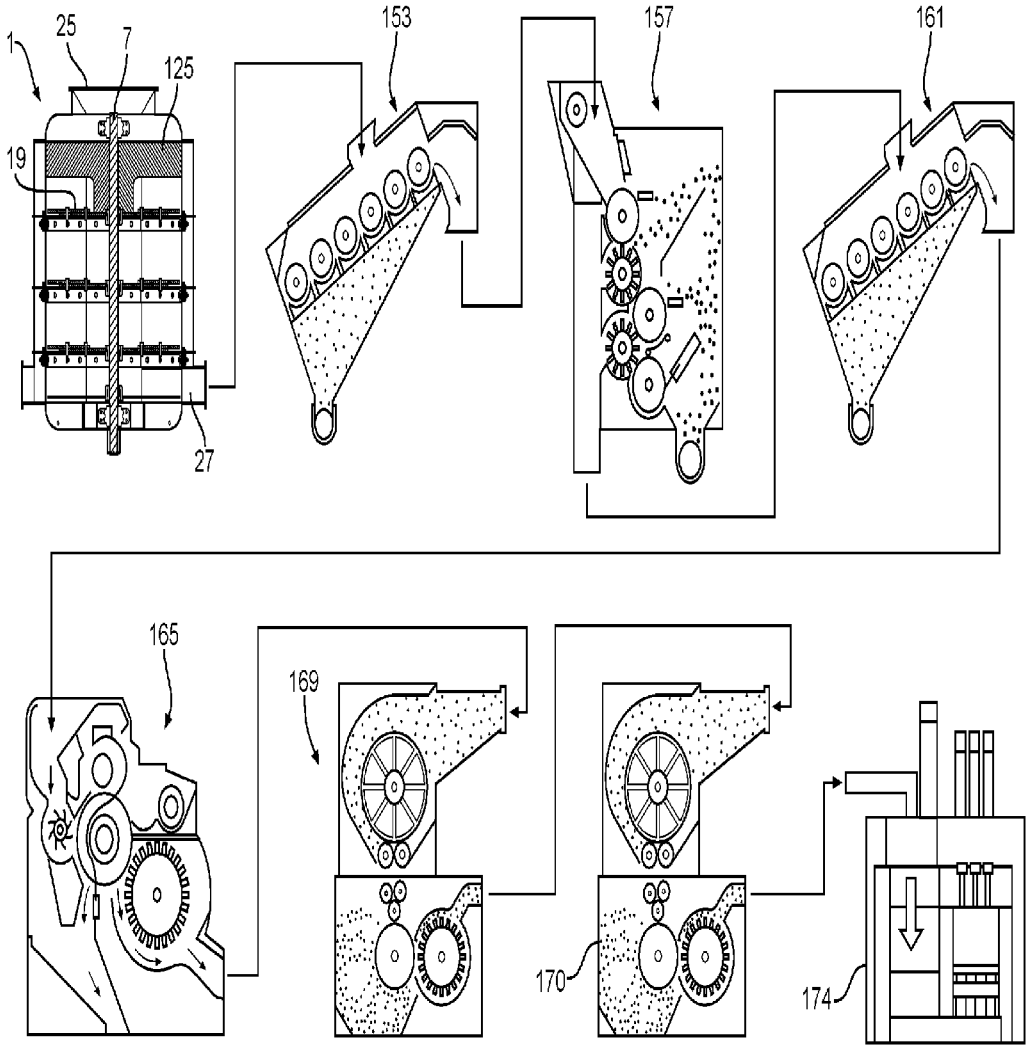
FIG. 14 is a schematic view of a grinder having a discharge connected to a cleaning system for separating fibrous and non-fibrous output from the grinder.

The grinder 1 incorporating deflectors 125 is particularly well suited for grinding composite products incorporating rigid and non-rigid material. Such composite products include carpet and shoes, plastics, automobile waste residue, furniture waste, etc. FIG. 14 is a schematic view of a grinding and processing system adapted for separating carpet fibers from its backing. The carpet fibers general comprise relatively long strands or strand bundles. Carpet is formed by looping the strands through a mesh backing and then applying a coating such as, latex, polyurethane or calcium carbonate over the backing to fix the strands to the backing.

In a first step of a carpet recycling process, the carpet is cut into sections sized to fit through the entrance chute 25 of the grinder 1. The properly sized carpet sections are then fed into the grinder housing 5 through entrance chute 25. In the grinder 1, the carpet is chopped or ground by the hammers 11 rotating past the angle deflectors 45 projecting inward from the sidewall sections 15. The ground carpet is further processed as it moves past the second and third cutter discs 9 and is then blown out of the housing 5 by the fan disc 10. After being processed by the cutter discs 9, the fabric or fiber bundles are substantially completely separated from the material forming the carpet backing such as polyurethane, latex and $CaCO_3$. The carpet fibers are generally left intact with good fiber integrity and fiber length as when it entered the shredder and the backing ($CaCO_3$)is ground into relatively small particles that are interspersed with the fibers.

The grinder 1 is connected in series to a plurality of fiber separating and processing machines or ginning equipment used to separate the fibers from the ground backing material. Processed material blown out of the grinder discharge chute 27 is blown through a first duct to a Condenser to remove air and loose backing material and other debris, it also makes a bat of material for more efficient cleaning then through a cylinder cleaner 153.

A typical cylinder cleaner consists of six or seven revolving spiked cylinders that turn about 400 rpm. These cylinders convey the carpet fibers over a series of grid rods or screens, agitate the fibers, and allow the finely ground, rigid backing material and debris to fall through openings for disposal or segregation. Cylinder cleaners break up large wads and generally get the carpet fibers in good condition for additional cleaning and any required drying. They may be used in either a horizontal position or inclined at an angle of about 30 degrees (inclined cleaners).

The processed carpet fibers, along with retained rigid material exits the first cylinder cleaner 153 and is blown through a second duct to a stick machine 157. The stick machine 157 can be used to separate the longer backing fiber from the shorter face fiber. Stick machines use the centrifugal force created by high speed saw cylinders to sling off heavier ground backing material while the fiber is held by the saw. Inside a stick machine, longer backing fiber is wiped onto the saw teeth by stationary wire brushes. Grid bars or stationary wire brushes are located around the saw cylinder to reduce the amount of longer backing fiber that is thrown off the cylinder. The shorter face fiber which is thrown off with the foreign matter is picked up by reclaimer saws and directed to the lint cleaner. Reclaimer saw cylinders are similar to main slingoff cylinders, but usually run slower and have more grid bars. The foreign matter that is slung off the reclaimer feeds into the lint cleaner.

Fiber material exiting the stick machine 157 is then fed through a second cylinder cleaner 161 for further processing.

Fiber material exiting the second cylinder cleaner 161 is preferably then fed into a gin stand 165. The gin stand 165 consists of a set of saws rotating between ginning ribs. The saw teeth pass between the ribs at the ginning point. Here the leading edge of the teeth is approximately parallel to the rib to pull the fibers from the ground backing rather than cutting them. The actual ginning process (separation of long fiber and short fiber) takes place in the roll box of the gin stand. When all the long fibers are removed, the short fibers are pulled down between the ginning ribs and fall onto a conveyor under the stand. Lint is removed from the saw by a rotating brush. The short fibers are then conveyed to the next machine in the ginning system, usually a lint cleaner. In the process shown, two lint cleaners 169 and 170 are shown in series. It is to be understood that the gin stand is not used on all types of material.

Gins typically use two types of lint cleaners, air jet and saw. The airjet lint cleaners are directly behind the gin stand or in lieu of and use centrifugal force to remove ground backing from the fiber as it makes a sharp turn in the duct work. In saw type lint cleaner, a condenser removes the fiber from the conveying air stream and forms it into a batt. The batt is fed to a saw cylinder which normally rotates at approximately 1,000 revolutions per minute. The saws carry carpet fiber over grid bars, which, aided by centrifugal force, remove ground backing or other foreign matter. The cleaned fiber is removed from the saw by a rotating brush which also provides air to convey it to the next machine. Lint cleaners can improve the grade of carpet fiber by removing foreign matter if the carpet fiber has the necessary color and preparation characteristics. Lint cleaners may also blend light spotted carpet so that it becomes a white grade.

Fibers exiting the ling cleaners are fed to a bale press 174 where it is baled and packaged for shipping.

Blowers, not shown, may be utilized to provide pressurized air for conveying the processed carpet between processing equipment. An important factor in preserving quality during ginning is the fiber moisture content. At higher moistures, carpet fibers are stronger, but trash or ground backing is harder to remove and cleaning machinery is less efficient. At low moisture, fibers are easily broken. Consequently, controlling fiber moisture content is a compromise between good trash removal and quality preservation. For most conditions, carpet should be ginned at 6 to 7 percent moisture. The temperature of the conveying air is regulated to control the amount of drying. To prevent fiber damage, the maximum temperature in the drying system should be kept below 110° F.

Computer control of the ginning process is one way to ensure that the appropriate drying and cleaning are done to the fiber. Process control uses instruments to determine trash, color and moisture content of the fiber throughout the ginning process. From this information, machine adjustments are continually made to the feed rate, the drying temperature and number of drying stages, the number of lint cleaners, and finally the moisture content of the fiber as it is packaged in the bale.

It is to be understood that the number and order of ginning processing equipment used to separate the fibers from the non-fibrous materials can be varied to obtain the desired output. For example, it is foreseeable that for some applications, such as processing shoes, a stick machines alone might be used or in lieu of the cylinder cleaners or gin stand. It is also to be understood that a plurality of each type of ginning equipment could be used in parallel. These pieces of ginning and separating equipment have been modified to meet the physical demands of the chosen feedstock It is to be understood that while certain forms of the present invention have been illustrated and described herein, it is not to be limited to those specific forms or arrangement of parts described and shown except in as so far as set forth in the following claims. As used in the claims, identification of an element with an indefinite article "a" or "an" or the phrase "at least one" is intended to cover any device assembly including one or more of the elements at issue. Similarly, references to first and second elements, or to a pair of elements, is not intended to limit the claims to such assemblies including only two of the elements, but rather is intended to cover two or more of the elements at issue. Only where limiting language such as "a single" or "only one" with reference to an element, is the language intended to be limited to one of the elements specified, or any other similarly limited number of elements.

What is claimed:

1. A grinder comprising:

a housing having a plurality of sidewall sections, a top wall, and a bottom wall;

a shaft rotatably mounted in the housing between the sidewall sections;

a cylinder encasing at least a portion of the shaft;

a cutter disc mounted on the shaft;

at least one hammer mounted on the first cutter disc;

at least one angle deflector mounted on at least one of the sidewall sections; and at least one generally planar deflector fixedly mounted in the grinder above the cutter disc and extending along a radius of the housing from one of the sidewall sections towards the shaft, said at least one generally planar deflector including (i) a main body portion having a lower edge, and (ii) a deflector leg depending from the main body portion and having an outside edge, said lower edge and said outside edge being configured to cooperatively define with the cutter disc a channel for the passage of material to be ground said main body portion of the at least one generally planar deflector includes a radially inside end proximate the shaft, and the deflector leg extends downward from the radially inside end of the main body portion.

2. The grinder according to claim 1, wherein the main body portion is between the top wall and the cutter disc.

3. The grinder according to claim 1, wherein the cutter disc includes a radially-extending weighted portion operable to increase rotational inertia during operation of the grinder.

4. The grinder of claim 1, said housing comprising a door, wherein said top wall and bottom wall are each divided into respective first sections and second sections, said first sections forming part of a main housing, and said second sections forming part of the door, wherein a line of division between the first sections and the second sections extends through an axis of rotation of the shaft.

5. The grinder of claim 4, said door being hingedly connected to said main housing.

6. The grinder of claim 4, wherein the rotor may be installed or removed through an opening provided by swinging open the door.

7. The grinder of claim 4, wherein the housing comprises eight sidewall sections, wherein the door comprises three of the sidewall sections, and the main housing comprises five of the sidewall sections.

8. The grinder of claim 1, wherein said main body portion of the at least one generally planar deflector extends downward from said top wall a distance that is about half the distance between the top wall and the cutter disc.

9. The grinder of claim 8, wherein the deflector leg extends closer to the cutter disc than the main body.

10. The grinder of claim 1, wherein said grinder comprises a pair of said generally planar deflectors, wherein each generally planar deflector extends from a respective sidewall section towards the shaft, said pair of deflectors being in alignment.

* * * * *